United States Patent [19]

Gerteis

[11] Patent Number: 4,470,170

[45] Date of Patent: Sep. 11, 1984

[54] HINGE ARRANGEMENT

[76] Inventor: Franz Gerteis, Diegeringerstr. 12, 7886 Murg 2, Niederhof, Fed. Rep. of Germany

[21] Appl. No.: 372,087

[22] Filed: Apr. 26, 1982

[30] Foreign Application Priority Data

May 11, 1981 [DE] Fed. Rep. of Germany ..... 3118641

[51] Int. Cl.[3] ..... E05D 15/30

[52] U.S. Cl. ..... 16/345; 16/334; 16/363; 16/364; 16/370

[58] Field of Search ..... 16/323, 345, 346, 348, 16/358, 360, 374, 287, 288, 302, 370, 371, 363, 364, 369, 368, 282, 294, 311, 334

[56] References Cited

U.S. PATENT DOCUMENTS 3,626,548 6/1969 Grunert ..... 16/370 X

*Primary Examiner*—Mark Rosenbaum
*Assistant Examiner*—Joseph M. Gorski
*Attorney, Agent, or Firm*—Werner W. Kleeman

[57] ABSTRACT

A hinge arrangement for various types of movable objects, such as doors, windows, flap members and so forth. In the case of thick-wall doors having shutters or ornamental strips mounted thereat, equally in the case of double doors, windows or flap members or similar type structures, especially in the construction and furniture industry, there exists the difficult problem of adjusting the pivoting movement of the door or other structure. Usually, there only can be attained opening angles of the door or other movable structure up to a range of about 180°. A hinge arrangement is disclosed which affords a relatively wide pivoting of the door or other structure during opening thereof, the pivoting movement being adjustable as to the degree or width of opening of the door or other structure. The hinge arrangement also allows opening angles of the door or other structure of 270° and more. Two angle levers or joints are pivotably mounted relative to one another at a common angle lever-pivot shaft, and additionally, at the ends thereof the angle levers are hingedly interconnected by two toggle levers. One angle lever is pivotably mounted about a pivot shaft or axle attached to a hinge support. The pivotal movement of the door or other structure is controllable by means of a lever arm of one of the toggle levers. For control purposes there are provided guide grooves and guide pins. Arresting means render possible arresting of the hinge arrangement in predeterminable positions.

8 Claims, 3 Drawing Figures

HINGE ARRANGEMENT

BACKGROUND OF THE INVENTION

The present invention relates to a new and improved construction of a hinge arrangement for various types of movable objects or structures, such as doors, windows, flap members and the like, by way of example and not limitation.

Generally speaking, the hinge arrangement of the present development is of the type comprising a first angle lever and a second angle lever which are pivotable about a common pivot shaft or axle. The first angle lever is pivotably mounted at a first end thereof about a first stationary pivot pin or axle, and the second angle lever possesses at a first end thereof a pivot shaft or axle which is pivotably connected by means of a first toggle lever or joint with a second end of the first angle lever.

A hinge arrangement of the aforementioned type is disclosed, for instance, in German Patent Publication No. 2,617,071, published Nov. 3, 1977. With that prior art hinge construction two angle levers are mounted in a common pivot shaft, however not located at their ends. One of these angle levers is pivotably mounted at one end at a hinge support or carrier and is hingedly connected at its other end by means of a toggle lever with the other or second angle lever. The toggle pivot shaft of this toggle lever and the pivot shaft or pin by means of which the second angle lever is articulated to the toggle lever are secured to the door which is to be opened and closed by means of the hinge structure. The other end of the second angle lever is articulated or hingedly connected by means of a single-arm lever likewise with the hinge support. Such type of hinges or hinge structures are suitable for opening a door up to an angle of about 180° with reference to the closed position of the door.

A further construction of hinge arrangement is disclosed in German Patent Publication No. 2,526,433, published Dec. 30, 1976.

SUMMARY OF THE INVENTION

It is a primary object of the present invention to provide an improved hinge arrangement or structure which can be adjusted with respect to the opening positions thereof, and which hinge arrangement renders possible opening of a door or other structure up to angles of 270° and more.

Another important object of the present invention relates to a new and improved construction of a hinge arrangement for movable structures or objects, such as doors, windows, flap members, lids, covers and so forth, which hinge arrangement is relatively simple in construction and design, quite economical to manufacture, extremely reliable in operation, not readily subject to breakdown or malfunction, and requires a minimum of maintenance and servicing.

Now in order to implement these and still further objects of the invention, which will become more readily apparent as the description proceeds, the hinge arrangement of the present development is manifested by the features that, the second end of the second angle lever is connected by means of a second toggle lever or joint with the stationary pivot shaft or pin of the first angle lever.

According to further aspects of the invention there is provided a lever guide arrangement which is operatively connected with the second toggle lever and enables a predeterminable deflection or pivoting of the first toggle lever as a function of the pivot angle of the first angle lever about its stationary pivot shaft.

Further, the invention contemplates that at least one lever guide or lever guide arrangement is operatively connected with a guide lever which interconnects the toggle pivot shaft or pin of the second toggle lever with the second angle lever.

A particular advantage of the invention resides in the fact that the hinge arrangement has wide or expansive fields of application and requires a relatively small amount of space. In the 270°-open position of the door or other movable object there practically does not arise any disturbance or hindrance for individuals wishing to pass through the door or other structure or object.

It is particularly advantageous to control the pivoting movement of the toggle lever-pivot shaft of the second toggle lever as a function of the pivot angle of the first angle lever, i.e. as a function of the opening angle of the door, and thus, to adjust the desired pivoting range and, as the case may be, the lifting-off of the door from, for instance, closet, safe or door frames or the like during opening and closing of the door. Such type of relatively wide lift-off movement is particularly then required when thick-wall doors, double doors or doors containing ornamental strips or the like, during opening thereof through angles of 90°, 100° or 270°, should not abut against a wall or other hindrance bounding at such corresponding angular positions.

If for small opening angles of the door up to about 90° the pivot-out movement of such toggle lever-pivot shaft —sometimes simply referred to as a toggle pivot shaft or axle—is maintained practically unchanged with respect to the closed position of the door and subsequently, with increasing opening angle of the door, pivoted in the counterclockwise direction about the stationary pivot shaft or pin secured at the hinge support, then there can be realized a relatively wide lift-off or pivoting-in, respectively, of the door from the closure surface of the closet, safe, door frame and the like.

It is possible to realize such control in a simple manner by using, as previously stated, one or a number of guides which coact with a guide lever of the second toggle lever. The stationary guide elements which are required and coact with this guide lever can be mounted at the region of the hinge support, without requiring any appreciable amount of space. The guides can possess limiting or latching facilities which are operatively correlated to the correspondingly desired open positions of the door or the like. Thus, door opening limits or extents can be provided or set in a most simple manner for random opening angles of the door in a range of up to 270°, and there also can be provided and set the required latchable intermediate positions.

A particularly positive arresting of the door, especially in its closed position, can be realized by means of an arresting device attached to the door. This arresting device, in the closed position, comes into engagement with a suitable arresting mechanism or device at the first toggle lever or a second angle lever of the hinge arrangement.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

With reference to the drawings, it is to be understood that the inventive hinge arrangement has been illustrated and described strictly by way of example and not limitation, with respect to a door structure, although obviously the same can be used in other environments. Equally, as a matter of convenience in the description there has been used the term "door", which therefore is to be clearly understood as employed in its broader sense to encompass not only doors as such, but other appropriate movable structures or objects, such as windows, flap members, or the like, with which the hinge construction or arrangement of the invention can be advantageously used.

Figure 1:
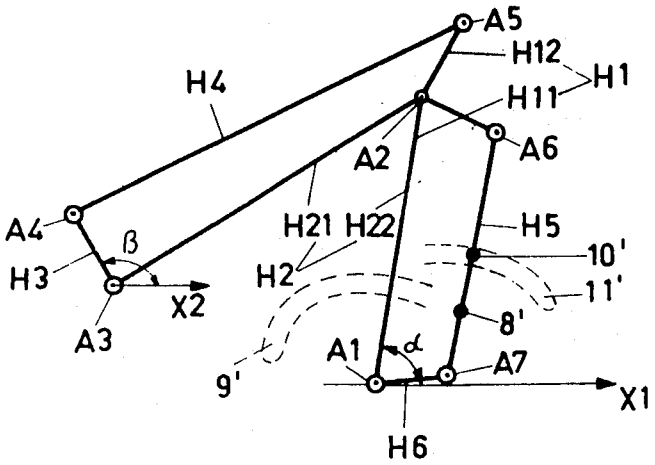
FIG. 1 is a principle schematic diagram illustrating the hinge connection of the hinge arrangement of the invention and equipped with a control device for its pivotal movement.

Turning attention now specifically to FIG. 1, reference character H1 designates a first double-arm angle lever containing an angle lever-pivot shaft or pin A2 —sometimes briefly simply referred to as an angle pivot shaft or pin—. The angle lever or angle lever arrangement H1 contains the two lever arms or arm members H11 and H12 which mutually enclose therebetween a predeterminable angle. The double-arm angle lever arrangement H1 is provided at its ends with the pivot shafts or pins A1 and A5. The pivot shaft A1 is stationarily secured to a hinge support or carrier 13, as best seen by referring to FIGS. 2 and 3.

Figure 2:
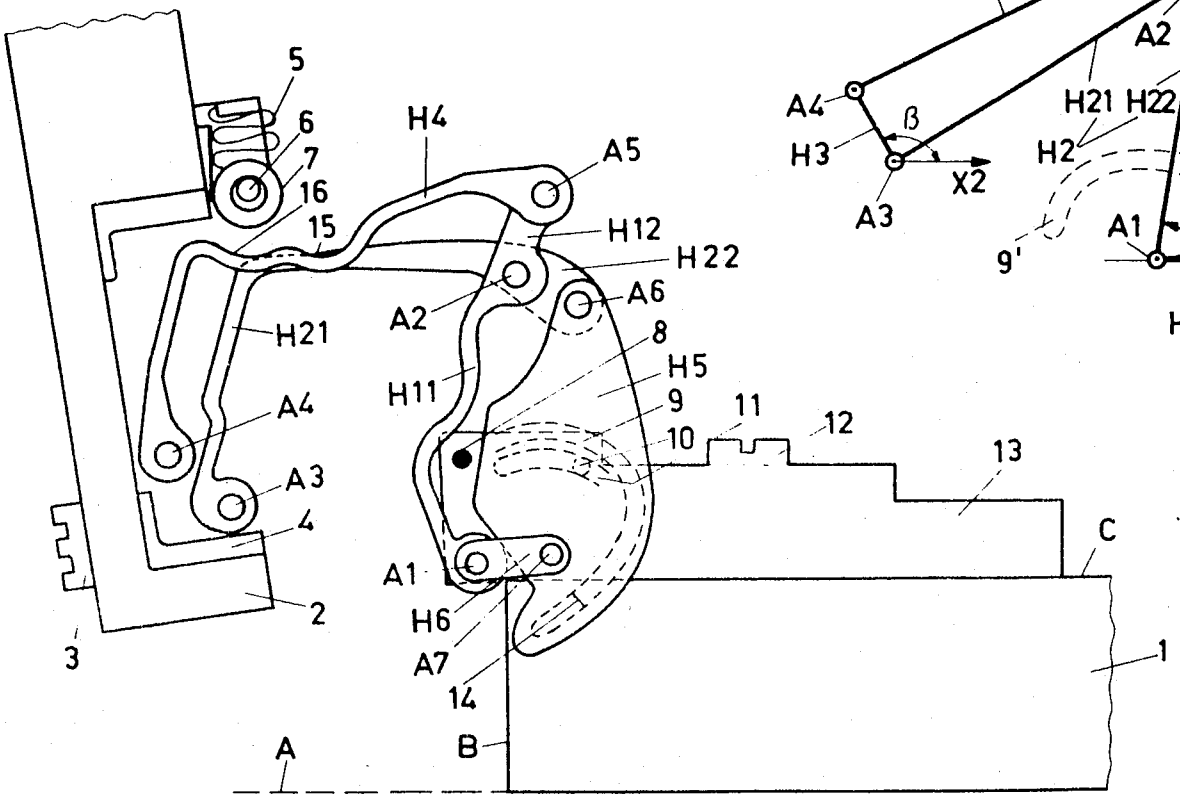
FIG. 2 illustrates a hinge arrangement according to the invention with open door position and provided with a somewhat modified control device in comparison to that shown in FIG. 1.
Figure 3:
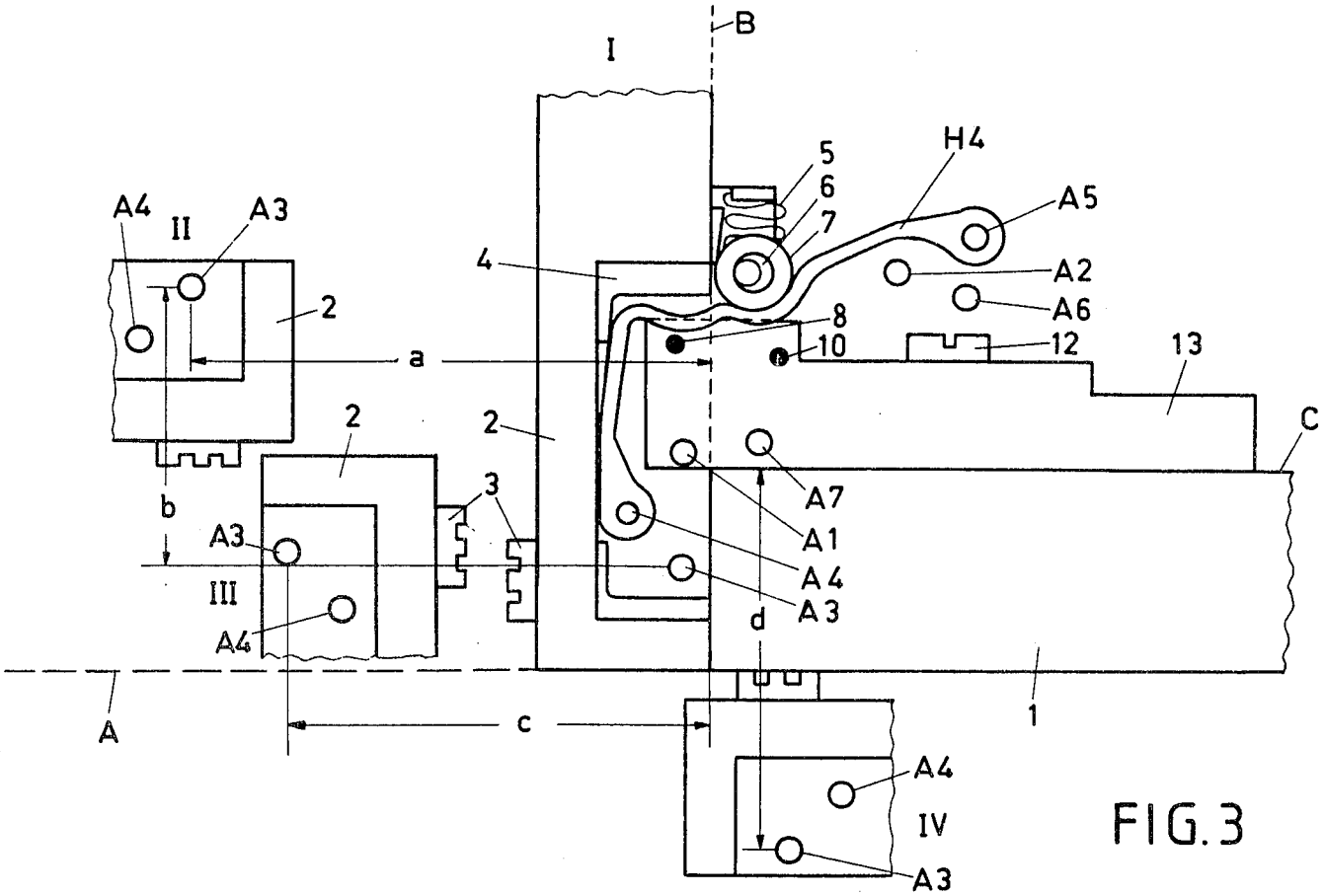
FIG. 3 is a simplified illustration of the hinge arrangement shown in FIG. 2, depicting the same in its closed position as well as in respective 90°-, 180°- and 270°-positions of the door.

A second double-arm angle lever H2 containing the two lever arms or arm members H21 and H22, which likewise mutually enclose a fixed angle with one another, conjointly possesses in conjunction with the first angle lever H1 the angle pivot shaft or pin A2, so that both of the angle levers H1 and H2 are pivotably mounted about such pivot shaft or pin A2. The second angle lever H2 possesses at the ends of the lever arms H21 and H22 the pivot shafts or pins A3 and A6, respectively. The pivot shaft A3 is secured in a hinge or pivot housing 4 of, for instance, a door member 2, as also best seen by referring to FIGS. 2 and 3. The pivot shafts A3 and A5 are connected by means of a first toggle lever or joint composed of the lever arm or arm member H3 and a guide link or lever arm H4. Both lever arms H3 and H4 have a common toggle pivot shaft or pin A4, which likewise is arranged at the hinge housing 4 of the door 2 (FIGS. 2 and 3). The distance between the pivot shafts or pins A3 and A4, in the arrangement of FIGS. 2 and 3, corresponds to the lever member or lever H3 shown in FIG. 1. Furthermore, the pivot shafts or pins A1 and A6 are hingedly connected with one another by means of a second toggle lever containing the lever arms or arm members H6 and H5 which possess a common toggle pivot shaft or pin A7. Secured to the lever arm H5, hereinafter designated as the guide lever, are the guide pins 8' and 10' which are provided for the purpose of engaging in the broken line indicated guide grooves 9' and 11', respectively. These guide grooves 9' and 11' are provided at the hinge support or carrier 13 which has not been particularly illustrated in FIG. 1.

Reference numeral $\alpha$ designates the pivot angle between a straight line x1 taken through the stationary pivot shaft A1 and the lever arm H11. Reference numeral $\beta$ designates the pivot angle between a straight line x2 extending essentially parallel to the straight line x1 and taken through the pivot shaft or pin A3 and the lever arm H3.

Continuing, in FIG. 2 reference numeral 1 designates, by way of example, a closet wall in top plan view at which there is secured by means of a threaded bolt or screw 12 or equivalent fastening expedient the hinge support or carrier 13. Attached to a projection or protruding portion of the hinge support 13 extending out of the closure surface B of the closet wall are the pivot shaft or pin A1 and a guide pin 8. In the illustrated position of the hinge arrangement this guide pin 8 is located in a position shortly prior to engagement with the therewith coacting and interfitting guide groove 9 which has been shown in broken lines and which is provided at the under side of the guide lever or lever member H5. This guide groove 9 is open at the depicted left-hand side of the showing of FIG. 2 and is closed at the lower end thereof for the purpose of limiting the opening of the door 2. Reference numeral 14 designates a stop or latch device disposed within the guide groove 9. A further guide pin 10 or equivalent structure attached at the hinge support 13 engages with the broken line illustrated guide groove 11 which is provided at the under side of the guide lever H5 in a circular configuration with respect to the second toggle pivot shaft or pin A7. The guide groove 11 is closed at the left-hand end and open at the right-hand end, as shown in FIG. 2.

Mounted at the partially illustrated door 2 at the outside or outer surface thereof is an ornamental ledge 3 or equivalent structure and inset at the inner side or surface thereof is the hinge or pivot housing 4 containing both of the pivot shafts or pins A3 and A4 arranged therein. Externally of such hinge or pivot housing 4 there is mounted at the inner side of the door 2 an arresting device or mechanism which possesses a compression or pressure spring 5 acting against an arresting roll 7 or equivalent structure and a limiting device or limiter 6 for limiting the movement of the arresting roll 7. The guide link H4 possesses curved arresting portions or curvatures 15 and 16. The curved arresting portion 15 is provided for the engagement of the arresting roll 7 in the closed position I of the door 2, as best seen by referring to FIG. 3. The curved arresting portion 16 can be used for arresting the door 2 in a partially open position. The limiter or limiting device 6 of the arresting device or mechanism then must be accommodated to the position of the curved arresting portion 16 for the corresponding door opening.

In FIG. 3 there have been omitted for reasons of clarity in the illustration the different levers with the exception of the guide link H4. The door positions II, III and IV designate various deflected or pivoted positions of the door 2 through angles of 90°, 180° and 270°, respectively.

The following table indicates by way of example lever lengths of an exemplary embodiment of the invention.

Lever arm H11 H12 H21 H22 H3 H4 H5 H6

Length in mm 27.3 8.4 35.8 6.8 7.7 43.5 24.5 7.5

For these dimensions there are valid the following distances and deflection or pivoting movements of the door with respect to the door positions II, III and IV:

In the door position II the perpendicular distance or spacing a of the pivot shaft A3 from the closet wall-closure surface B amounts to 51.2 mm and the perpendicular distance or spacing b of this pivot shaft or pin A3 with respect to the position of the same pivot shaft A3 in the door position I amounts to 27.3 mm. The pivot angle $\alpha$ is equal to that in the closed position I. In the door position III the perpendicular distance or spacing c of the shaft A3 from the closet wall-closure surface B amounts to 41.5 mm. The pivot angle $\alpha$ increases by about 15°. The perpendicular spacing or distance d from the closet wall inner surface to the shaft A3 amounts to about 37.5 mm in the door position IV.

To obtain other distances there is advantageously employed a model where there can be adjusted the lever lengths and/or the guide elements.

The mode of operation of the hinge arrangement will now be explained based upon the drawings. In the closed door position I, according to FIG. 3, the pressure or compression spring 5 presses the arresting roll 7 against the curved arresting portion or curvature 15 provided at the guide link H4 and retains the door 2 closed. During opening of the door 2 it is necessary to initially overcome the spring force. By means of the angle lever H2 and the guide link H4 hingedly connected in the pivot or hinge housing 4 of the door 2 at the pivot shafts A3 and A4 the first angle lever H1, which is pivotable about the stationary pivot shaft or pin A1 is pivoted in the counterclockwise direction or opening sense of the hinge arrangement. As a result, the position of the toggle pivot shaft or pin A7 initially remains unchanged, as long as the guide pin or pin member 10 engages with the guide groove 11, since this guide groove 11 extends in a circular arcuate-shaped configuration about the toggle pivot shaft or pin A7.

In the position depicted in FIG. 2 the guide pin 10 is located at a point shortly before the end of the related guide groove 11 which is open towards the right-hand side of the illustration. If the door 2 is further opened, then this guide pin 10 comes out of engagement with the guide groove 11. Shortly prior to this happening the other guide pin 8 engages with the related guide groove 9 thereof which, during further opening of the door 2, assumes the guiding control of the guide lever H5 and thus the toggle pivot shaft A7. By means of this guide arrangement there can be accomplished a relatively wide pivoting-out of the door 2. During opening of the door 2 through 90° there is not reached or crossed the line A by the door 2, this line A for instance designating the extent or course of a room wall.

If there should be limited opening of the door 2 to an angle of 180°, because, for instance, before the closet represented in FIG. 3 by the closet wall 1 and the door 2, there is positioned a further not particularly shown closet —in the direction of the door position IV—, which should not be contacted by the door 2 during opening thereof, then the opening movement of the hinge arrangement can be limited, for instance, by the stop or impact member 14 located in the guide groove 9. The limiting of the opening movement can be adjusted or set with such type of stops or impact members to an opening angle of 270° or random intermediate angles. By means of the hinge arrangement there also can be attained opening angles exceeding 270°.

The closing of the door is accomplished in a manner corresponding to opening of the door only with opposite rotational sense of the angle lever H1 which is fixedly hingedly connected to the pivot shaft or pin A1. In the closed position I there is accomplished an automatic arresting of the hinge arrangement by means of the arresting device or mechanism 5, 6 and 7.

A somewhat different control of the guide lever H5 has been indicated in FIG. 1. In that arrangement the guide pins 8′ and 10′ secured at the guide lever H5 engage with related guide grooves 9′ and 11′, respectively, in accordance with the magnitude of the pivot angle $\alpha$, these guide grooves 9′ and 11′ being provided at the hinge or pivot support which has not been particularly shown in FIG. 1. The mode of operation of the guide arrangement corresponds to that already described.

The extent of the pivoting-out of the door during the opening operation can be particularly influenced by the guiding of the toggle pivot shaft or pin A7.

Of course, the invention is not limited to the described exemplary embodiments and modifications thereof are readily possible and will suggest themselves to those skilled in the art without departing from the underlying principles and concepts of the present development. Thus, for instance, the control of the guide lever H5 and the lever arm H6, and thus, the toggle pivot shaft A7 can be accomplished by means of a cam disk or cam element which is attached to the first angle lever H1. The cam also could be secured at the hinge support or at the closet wall and can be operatively connected by means of a guide element with the toggle pivot shaft or pin A7 or with the guide lever H5 and the angle lever H1.

What is important is that the toggle pivot shaft A7 is maintained, for small opening angles of the door up to about 90°, essentially in the same position as in the closed position, and then during enlargement of the opening angle of the door is pivoted in the counterclockwise direction about the stationary pivot shaft A1.

Instead of using guide grooves and guide pins there also could be employed other conventional guide elements.

Boundary or limit stops for the opening angle of the door 2 could be provided, for instance, in operative connection with the angle lever H1 or the guide link H4. Instead of using limit stops, or in addition thereto, there also could be provided latching positions for predetermined opening angles of the door, from which the door only could be moved after overcoming an adjustable arresting force which, for instance, is applied by the compression or pressure spring 5 or equivalent structure.

Furthermore, the hinge support or carrier 13 can be inset at the closet wall 1 or can be arranged at an inclined angle with respect to the straight line A. In such inclined position of the hinge or pivot support the hinge arrangement, in the closed position I of the door 2, requires very little space within the interior of the closet or the like.

Hinge constructions according to the invention are suitable for all types of doors, windows, flap members and so forth, which can be opened or closed with a hinge, for jointless contacting doors, windows, flap members, especially for the construction and furniture industry as well as for general industrial requirements or applications. They render possible during the opening operation a pivoting-out movement of the door or the like in such a manner that there does not arise any hindrance or obstruction of the pivot region between the closed door and the open door positions and there is possible a jointless assembly or construction, for instance of furniture.

By virtue of the pivoting-out of the door during the opening operation and which can be adjusted as concerns the opening width there is obtained a free space for thickwall doors and doors having mounted thereat frames, shutters or ornamental ledges or the like. With this arrangement there is possible a jointless fastening or mounting of corner and double doors, with the attendent advantage of a large pivot range.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A hinge arrangement comprising:
a first angle lever;
a second angle lever;
a common pivot shaft about which there are pivotable said first and second angle levers;
each of said first and second angle levers having opposed ends defining a first end and a second end;
a first stationary pivot shaft at which there is pivotably mounted the first angle lever at its first end;
a pivot shaft provided at a first end of the second angle lever;
a separate first toggle joint for pivotably connecting the pivot shaft at the first end of said second angle lever with the second end of the first angle lever; and
a separate second toggle joint for connecting the second end of the second angle lever with the stationary pivot shaft of the first angle lever.

2. The hinge arrangement as defined in claim 1, further including:
lever guide means operatively connected with the separate second toggle joint; and
said lever guide means enabling a predetermineable deflection of the separate first toggle joint as a function of a pivot angle of the first angle lever about its stationary pivot shaft.

3. The hinge arrangement as defined in claim 2, further including:
a guide lever with which there is operatively connected at least one of said lever guide means;
said separate second toggle joint having a toggle pivot shaft; and
said guide lever connecting said toggle pivot shaft of the separate second toggle joint with the second angle lever.

4. The hinge arrangement as defined in claim 3, wherein:
said lever guide means comprises at least one stationary pin and at least one guide groove operatively associated with the pin and arranged at said guide lever; and
said at least one guide groove possessing an at least circular arcuate-shaped configuration at least throughout a predetermined portion thereof.

5. The hinge arrangement as defined in claim 2, wherein:
said lever guide means comprises at least one stationary pin and at least one guide groove operatively associated with the pin and arranged at a guide lever; and
said guide groove possessing an at least circular arcuate-shaped configuration at least throughout a predetermined portion thereof.

6. The hinge arrangement as defined in claim 2, wherein:
the separate second toggle joint has a toggle pivot shaft; and
said toggle pivot shaft of the separate second toggle joint for pivot angles, measured from a closed position of the hinge arrangement up to a position pivoted-out through about 90°, essentially is maintained in an unaltered position.

7. The hinge arrangement as defined in claim 1, wherein:
the separate first toggle joint has a toggle pivot shaft;
said separate second toggle joint having a toggle pivot shaft; and
the pivot shaft arranged at the first end of the second angle lever and the toggle pivot shaft of the separate first toggle joint have a fixed spaced mutual relationship which is at least approximately equal to a fixed spaced mutual relationship between the stationary pivot shaft of the first angle lever and the toggle pivot shaft of the separate second toggle joint.

8. The hinge arrangement as defined in claim 1, wherein:
the separate first toggle joint contains a guide link member and a lever arm member;
at least one of said guide link and lever arm members being provided with at least one first arresting means which can be brought in at least one predeterminable door position into operative connection with a second arresting means secured at a door.

* * * * *